US005335569A

United States Patent [19]

Rowley

[11] Patent Number: 5,335,569

[45] Date of Patent: Aug. 9, 1994

[54] EYE SCREW DRIVING DEVICE

[75] Inventor: John H. Rowley, Gastonia, N.C.

[73] Assignee: R. H. Rowley Co., Gastonia, N.C.

[21] Appl. No.: 24,723

[22] Filed: Mar. 2, 1993

[51] Int. Cl.[5] ..... B25B 13/06

[52] U.S. Cl. ..... 81/125; 81/901

[58] Field of Search ..... 81/125, 901, 44, 487

[56] References Cited

U.S. PATENT DOCUMENTS

| | | | |
|---|---|---|---|
| 268,344 | 11/1882 | Wood | 81/125 |
| 300,317 | 6/1884 | Griffith . | |
| 841,472 | 1/1907 | Vanderherchen . | |
| 855,905 | 6/1907 | Rhoads . | |
| 882,937 | 3/1908 | Pegley . | |
| 985,087 | 2/1911 | Wilson . | |
| 1,124,981 | 1/1915 | Weaver | 81/125 |
| 1,392,796 | 10/1921 | Reinhalter | 81/125 |
| 2,697,371 | 12/1954 | Bowman | 81/125 |
| 4,689,881 | 9/1987 | Fall . | |

FOREIGN PATENT DOCUMENTS

| | | | |
|---|---|---|---|
| 206759 | 2/1909 | Fed. Rep. of Germany | 81/901 |
| 12045 | of 1914 | United Kingdom | 81/901 |
| 824774 | 12/1959 | United Kingdom | 81/901 |

*Primary Examiner*—D. S. Meislin

*Attorney, Agent, or Firm*—Shefte, Pinckney & Sawyer

[57] ABSTRACT

An eye screw driving device for insertion and removal of eye screws having a generally cylindrical elongate body with a generally eye-screw-shaped recess formed in one end thereof, having a cover slidable into and out of a covering relation with the recess to retain the eye screw therein, the recess having an upstanding post positioned therein to allow the recess to accept a number of different eye screws formed of the same diameter bolt stock, yet with different head sizes, the device being fitted within a mounting post allowing the device to he mounted in a rotary drive power tool.

12 Claims, 5 Drawing Sheets

EYE SCREW DRIVING DEVICE

BACKGROUND OF THE INVENTION

Eye screws are screws having a circular head portion formed from an elongate rod blank having a generally constant diameter and threads formed in one end. At a position immediately beyond the threads, the rod is bent to extend in a generally circular manner with the terminus of the rod closely adjacent the initial bend. This forms a screw having a head portion with an eyelet formed therethrough. Eye screws may be formed with different head sizes from the same diameter rod stock providing screws having the same diameter shank, yet with head portions bent to differing circular diameters and therefore different sized eyelets.

Eye screws are typically used in situations wherein a strand-like member must be attached to a wall, post, or other support surface. For example, eye screws are typically used to fasten support wire to a picture frame. Further, eye screws can be used in more industrial applications, such as for suspending support strands from ceilings or walls.

Unlike other conventional screws wherein a screwdriver fits in a slotted head portion to positively engage the screw for rotational driving insertion thereof into a support member, eye screws have no such slotted head, cannot interface with a screwdriver, and typically must therefore be inserted by hand. Using hand insertion, the most difficult time associated with inserting an eye screw is during the initial starting motions wherein the screw first pierces the support member. It can be difficult to provide the sufficient linear force necessary to drive the eye screw while maintaining the eye screw in position and applying the necessary torque to start the eye screw by gripping the eye portion. In the case of smaller eye screws, this can be especially difficult due to the diminutive gripping surface provided by the head portion and, if the requirement is for multiple eye screws, the problem can be multiplied accordingly. While the preceding discussion focused on inserting an eye screw, the same problems are applicable to removing eye screws. Further, similar problems are encountered with eye hooks which are similar in construction to eye screws except that the head portion is formed as a hook.

Additionally, today's handyman has access to rotary drive power screwdrivers which greatly increases the ability to rapidly insert or remove a number of conventional screws in untiring succession. However, like conventional screwdrivers, power screwdrivers have had no capability to engage and drive eye screws.

SUMMARY OF THE INVENTION

It is therefore an object of the present invention to provide an eye screw driving device, which addresses the aforesaid problems. More particularly, it is an object of the present invention to provide an eye screw driving device usable with a conventional rotary drive power tool, which will grip and align an eye screw or eye hook for insertion or removal, and driving movement by the power tool.

According to the preferred embodiment of the present invention, a device for driving eye screws of the type having an eyelet-shaped head portion and a shank extending therefrom for rotational penetration of a supporting member includes a body defining a rotational driving axis about which the body may be rotatably driven. A recess is formed in the body and opening to one end of the body for receiving the head portion of an eye screw and for positioning the shank to extend outwardly from the body in alignment with the rotational axis. A cover device is mounted on the body for selective sliding movement between an extended position disposed in covering relation to the recess for retaining the head portion of the eye screw therein and a retracted position out of covering relation to the recess for selective insertion and removal of eye screws into and from the recess.

The eye screw driving device further includes a mounting arrangement at the opposite end of the body from the recess, the mounting arrangement being configured for receipt in a chuck of a rotary drive tool.

Preferably, the cover device is slidable in a linear path of movement which is generally parallel to the rotational driving axis of the body.

It is further preferred that the present invention include an arrangement for holding the cover device in the extended disposition. For example, the holding arrangement may include an assembly for biasing the cover device into frictional contact with the body to resist freesliding movement of the cover without manual initiation of sliding movement. Alternatively, the holding arrangement may include an assembly for biasing the cover device into its extended disposition to also resist freesliding movement of the cover without manual initiation of sliding movement.

The body includes an upstanding post formed in the recess for insertion through the eyelet portion of the eye screw, and the recess includes a channel portion for positioning the shank portion of the eye screw for driving insertion thereof. The post is disposed at a spacing to the channel selected in relation to a predetermined cross-sectional dimension of the eye screw head portion, whereby the recess is adapted for selective receipt of any one of a plurality of eye screws having different head portion sizes formed of the selected cross-sectional dimension.

Optionally, the post of the eye screw driving device of the present invention may be selectively positionable to allow the device to accept a greater range of eye screw sizes.

According to one preferred embodiment, a series of substantially linearly aligned openings is formed in the body within the defined recess. A generally cylindrical post is provided and configured to have at least one spindle projecting outwardly from one end thereof. The spindle is configured for selective insertion into at least one of the openings for removably mounting the post in an upstanding manner within the defined recess. As before, the post is configured for insertion through the eyelet portion of an eye screw. Accordingly, the post may be selectively disposed at a desired, predetermined spacing to the channel by inserting the spindle into one of the linearly aligned openings.

According to another preferred embodiment, the post is again made movable however in this embodiment the post is not removable from the device. Specifically, an elongate slot is formed into the recess in which the post is fitted for sliding movement therein. An arrangement is provided for controlled movement of the post within the slot including a ball screw threadedly mounted to the post wherein rotation of the ball screw causes translatory movement of the post within the slot for selectively positioning the post in the recess. Accordingly, the post may be selectively disposed at a desired spacing to the channel by rotating the ball screw thereby causing the post to move within the slot.

The desired spacing corresponds to a selected cross-sectional dimension of the eye screw head portion, whereby the defined recess is adapted for selective receipt of any of a plurality of eye screws having differing head portion sizes and formed of differing cross-sectional dimensions.

DESCRIPTION OF THE PREFERRED EMBODIMENT

Figure 1:
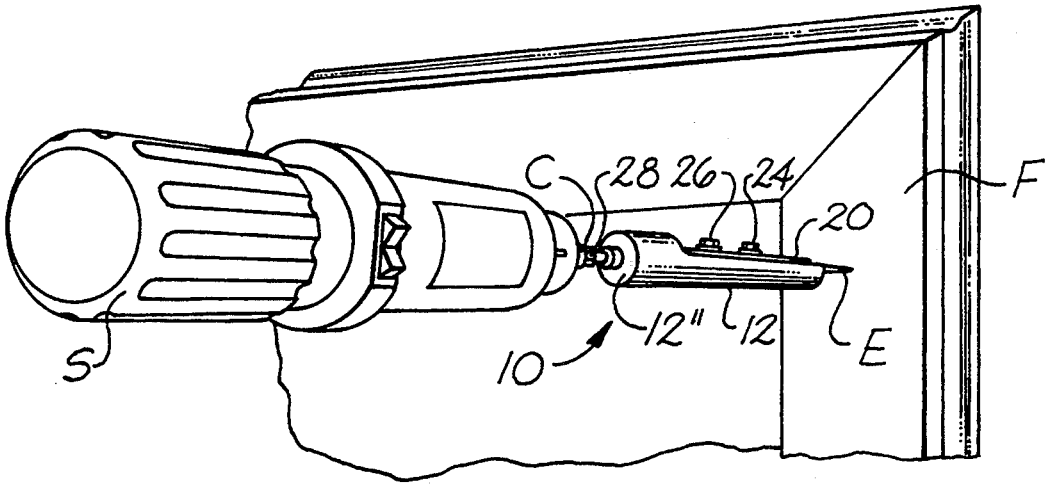
FIG. 1 is an environmental perspective view of an eye screw driving device according to the preferred embodiment of the present invention shown operationally attached to a rotary power tool.

Referring now to the accompanying drawings and more particularly to FIG. 1, an eye screw driving device is illustrated generally at 10 and is shown in an operational context attached to a conventional power screw driver S for driving an eye screw E into the backside of a picture frame F. Throughout the following discussion, reference is made to eye screws. However, it is to be understood that all embodiments of the present invention are useful for insertion and removal of eye hooks as well.

Figure 2:
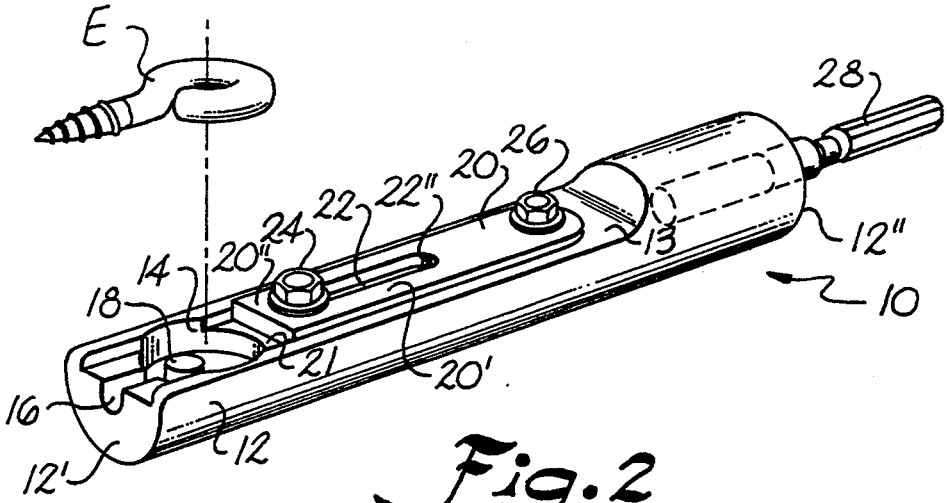
FIG. 2 is a perspective view of the eye screw driving device illustrated in FIG. 1 with the cover retracted exposing the recess for receiving an eye screw therein.

Turning now to FIG. 2, the eye screw driving device 10 includes a generally cylindrical elongate body 12 which is linearly truncated along about three-quarters of its length to provide a generally flat surface 13 resulting in a semi-circular cross-section at the forward end 12′ of the body 12 and a circular cross-section at the opposite, rearward end 12″ of the body 12. A generally circular recess 14 is formed in the flat surface 13 adjacent the forward end 12′ of the body 12, with a semicylindrical channel 16 formed in the flat surface 13 extending from the recess 14 to the forward end 12′ of the body 12. A generally cylindrical upstanding post 18 is formed in the recess 14 and is configured to fit within the eyelet portion of the eye screw E to stabilize and maintain the eye screw E in alignment with the driving axis of the body 12. While it is preferred that the post be cylindrical, with a circular end-on cross-sectional geometry it is to be understood that virtually any configuration will suffice. For example, the post could be triangular, hexagonal, or formed with virtually any other end-on cross sectional geometry. The configuration of the post 18 will be discussed in greater detail hereinafter. By the above, the circular recess 14, in combination with the channel 16 and the post 18, provides a form fitted receiving opening for a conventional eye screw E.

In order to maintain the eye screw in the recess during rotational operation of the device 10, a cover 20 is provided for selectively retaining the eye screw E in the recess 14 or allowing its removal therefrom. The cover 20 is a generally flat elongate rectangular member having an elongate slot 22 formed lengthwise therein. A shallow, relatively wide depression 21 is formed in the flat surface 13 of the body 12 rearwardly of the recess 14. The depression 21 is configured to accept the cover 20 and forms a track in which the cover 20 slides, as will be discussed in greater detailed hereinafter.

Figure 4:
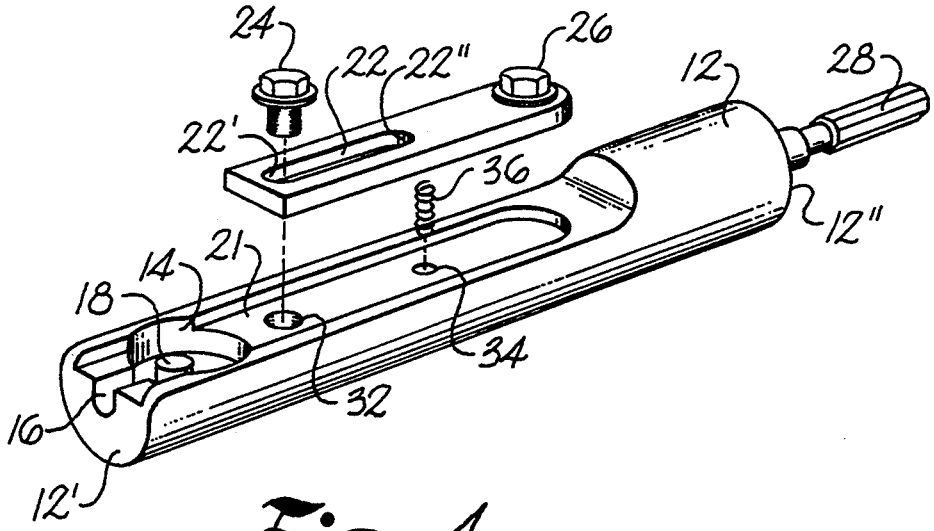
FIG. 4 is an exploded perspective view of the eye screw driving device illustrating the assembly for biasing the cover against the body.

With reference to FIG. 4, a machine screw 24 is provided to mount the cover 20 to the body 12. A threaded opening 32 is formed in the flat surface 13 within the depression 21. The machine screw 24 is inserted through the slot 22 formed in the cover 20 with the shank portion extending through the slot and the underside of the head portion in surface abutment with the outer surface of the cover 20, adjacent the slot 22. The screw 24 is threadedly engaged in the aforesaid opening 32 and tightened to the extent that the cover 20 is retained within the depression 21 yet remains free to slide between a retracted position wherein the screw 24 is in abutment with the forwardmost wall 22′ forming the slot 22 in the cover 20 and a retracted position wherein the screw 24 is in abutment with the rearwardmost wall 22″ forming the slot 22 in the cover 20.

In order to maintain the cover 20 in any given position to prevent freesliding movement thereof, a biasing arrangement is provided. To that end, and with continued reference to FIG. 4, a second opening 34 is formed in the flat surface 13 intermediate the threaded opening 32 and the rearward portion of the depression 21. A biasing spring 36 is positioned in the opening 34 intermediate the body 12 and the cover 20. The spring acts to bias the rearward portion of the cover 20 outwardly in a direction away from the body 12 and against the screw 24. The upward biasing of the rearward portion of the cover 20 causes the cover 20 to tend to pivot slightly at the screw 24 thereby biasing the portion of the cover forward of the screw 24 downwardly against the flat surface 13. When the cover 20 is in its extended position, the forward portion of the cover 20 is downwardly biased over the opening, thereby for retaining the eye screw E within the recess 14.

Figure 9A:
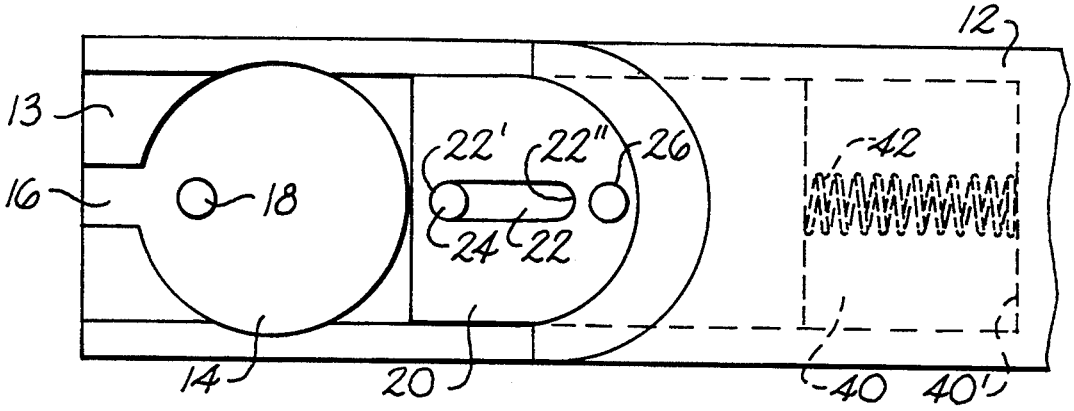
FIG. 9*a* is a top plan view of the end portion of the eye screw driving device illustrating an assembly for biasing the cover into an extended disposition illustrating the cover in a retracted position.
Figure 9B:
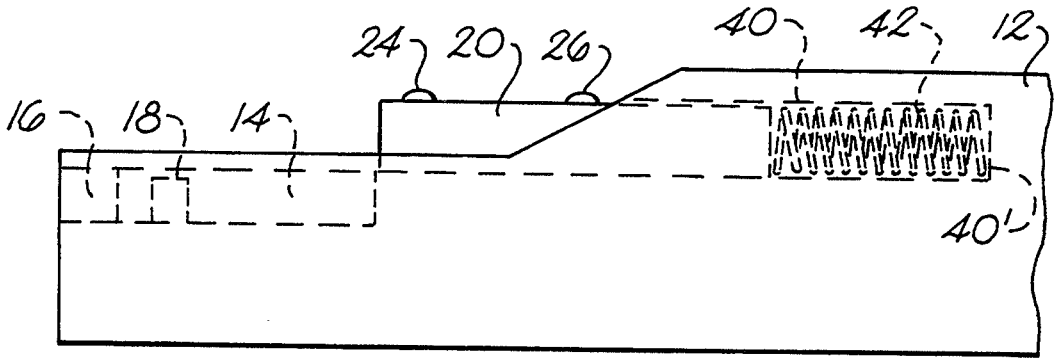
FIG. 9*b* is a side view of the eye screw driving device illustrated in FIG. 9*a;*

Optionally, the biasing arrangement may be configured to naturally bias the cover 20 in its extended disposition. Referring now to FIGS. 9*a* and 9*b*, the body 12 of the device is truncated along about one quarter of its length resulting in a smaller generally flat surface 13. Immediately behind the flat surface 13 a cavity 40 is formed into which the cover 20 may be fitted. A spring 42 is disposed intermediate the end wall of the cover 20 and the back wall 40' of the cavity 40. The cover 20 may be retracted to a position wherein the screw 24 is in abutment with the forwardmost wall 22' forming the slot 22 and the cover 20 as previously described. In this disposition, the spring 42 is in a compressed state.

Figure 10A:
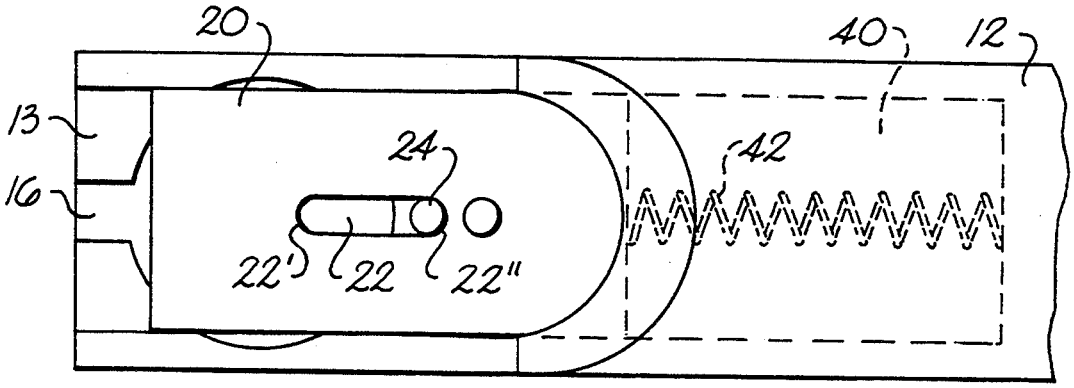
FIG. 10*a* is a top plan view of the eye screw driving device illustrated in FIG. 9*a* with the cover in an extended disposition.
Figure 10B:
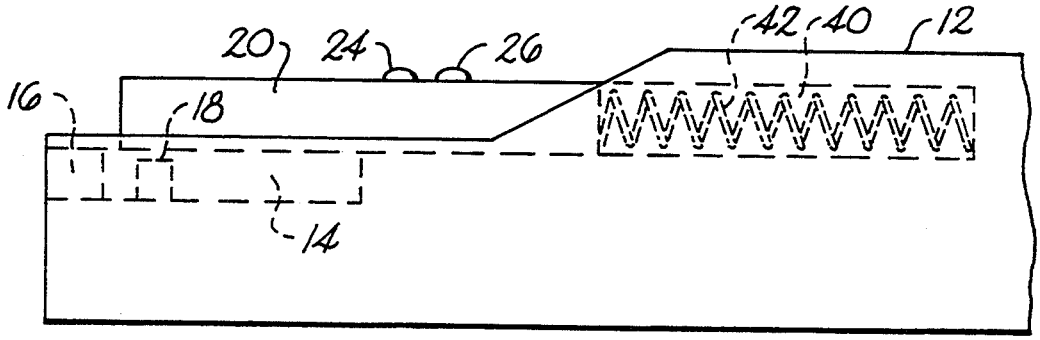
FIG. 10*b* is a side view of the eye screw driving device illustrated in FIG. 10*a*.

Referring now to FIGS. 10*a* and 10*b*, if the cover 20 is released, the spring 42 biases the cover 20 forwardly from within the cavity outwardly over the recess 14 until the screw 24 is in abutment with the rearward walls 22'' of the slot 22 formed in the cover. In this manner, the cover 20 is naturally biased into an extended disposition over the recess 14 while allowing manual movement of the cover 22 to its retracted position as seen in FIGS. 9*a* and 9*b* for insertion of an eye screw in the recess 14.

An additional screw 26 is fixed to the cover 20 rearwardly of the slot 20 to provide a thumb contact area for easy manual actuation of sliding movement of the cover 20. Further, a generally hexagonal mounting post 28 projects outwardly from the rearward end 12'' of the body 12 for mounting engagement with the chuck of the rotary power tool S, as seen in FIG. 1.

Figure 5A:
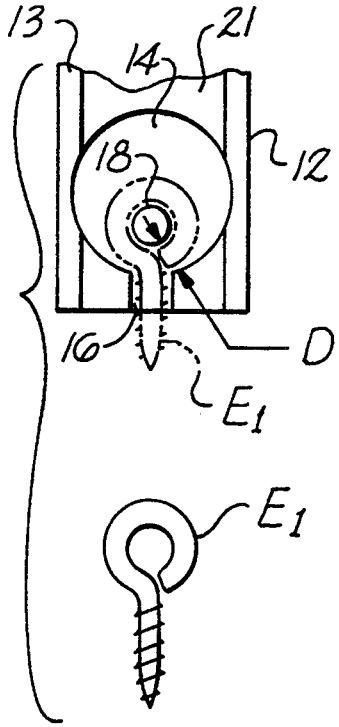
FIGS. 5*a* and 5*b* are top plan views of the end portion of the eye screw driving device respectively illustrating the acceptance of relatively smaller and larger eye screws in the recess formed therein.
Figure 5B:
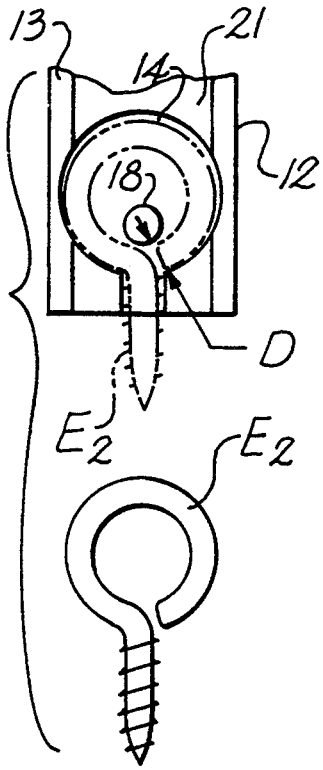

The present invention is configured for use with several different eye screws of varying head size, so long as the cross-sectional diameter of the bolt stock from which the eye screw is formed remains constant. This feature is best illustrated in FIGS. 5*a* and 5*b*. With reference to FIG. 5*a*, the post 18 is positioned within the recess 14 to be a predetermined distance D away from the walls forming the recess 14 at a position adjacent the channel 16, the spacing from the walls forming the recess 14 being equidistant on both sides of the channel 16 opening. This distance D corresponds generally to the diameter of the bolt stock from which a given range of conventional eye screws are formed. As seen in FIG. 5*a*, a first eye screw $E_1$ is formed with a relatively small head portion and may fit snugly within the recess 14 with the post 18 projecting through the eyelet portion of the eye screw $E_1$ and the rod forming the head portion disposed and securely held intermediate the post 18 and the walls forming the recess 14. The inner portion of the eyelet of the first eye screw $E_1$ fits relatively snugly around the upstanding post 18, as illustrated in broken lines in FIG. 5*a*.

Referring now to FIG. 5*b*, a second eye screw $E_2$, formed of the same bolt stock as the first eye screw $E_1$ of FIG. 5*a*, is formed with a relatively larger head portion than the first eye screw $E_1$, resulting in a larger eyelet in the head portion of the second eye screw $E_2$. The second eye screw $E_2$ also fits snugly within the recess 14 with the post 18 projecting through the eyelet portion of the eye screw $E_2$ and the rod forming the head portion disposed and securely held intermediate the post 18 and the walls forming the recess 14 as was the case with the first eye screw $E_1$. Since the second eye screw $E_2$ is formed of the same diameter bolt stock as the first eye screw $E_1$, the post 18 fits snugly against the inner surface of the opening in the head portion of each eye screw $E_2$ adjacent the shank, while the outer portion of the second eye screw $E_2$ fits snugly against the walls forming the recess 14, as illustrated in broken lines in FIG. 2.

The above description illustrates the two extremes of eye screw sizes capable of use with the eye screw driving device of the present invention. However, it will be understood that other sizes of eye screws between the two above-described will fit within the recess 14. Further, the device may be formed with a differently sized post 18 or recess 14 to accommodate a different range of eye screw sizes.

Figure 6:
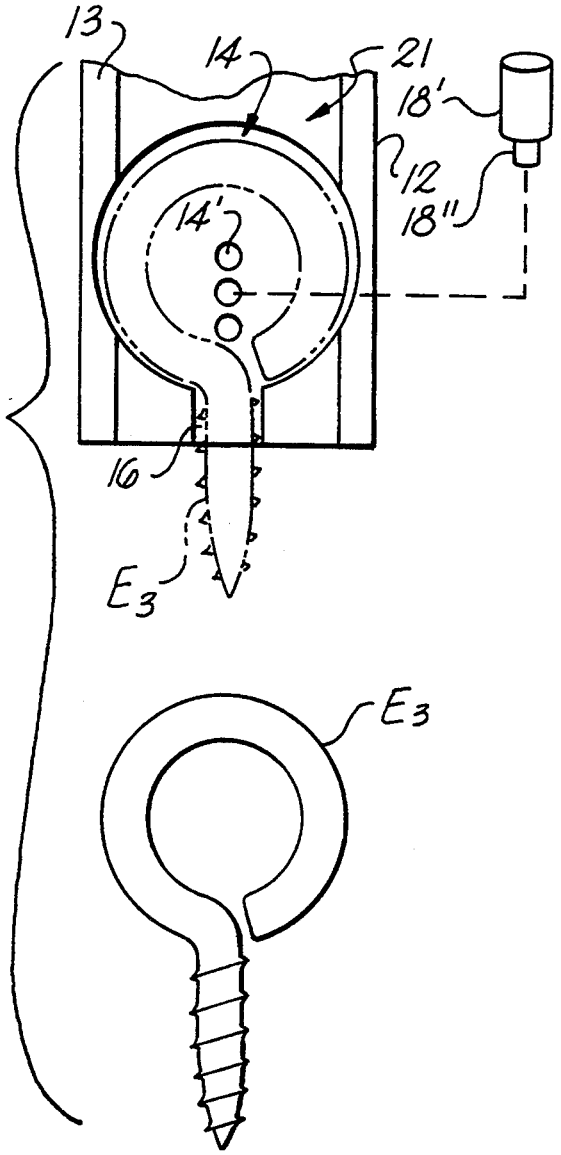
FIG. 6 is a top plan view of the end portion of the eye screw driving device illustrating a first embodiment of an optional selectively positionable post assembly for using the present invention with a range of eye screw sizes.

Optionally, the eye screw driving device of the present invention may be configured to accept a broader range of eye screw sizes. To that end, and with reference to FIG. 6, a removable post 18' is provided. The removable post 18' is sized similarly to the fixed post 18, however, the removable post 18' includes a mounting spindle 18'' projecting outwardly from one end thereof. A series of substantially linearly aligned openings 14' is formed in the body 12 of the device 10 within the recess 14. The removable post 18' may be selectively mounted within the recess 14 by inserting the spindle 18'' into a selected opening 14'. The opening 14' is selected to provide a spacing between the removable post 18'' and the channel 16 to accommodate the cross-sectional diameter of the head portion of a selected eye screw $E_3$. By moving the removable post 18' closer to or farther away from the channel 16, a range of eye screws having a range of cross-sectional diameters may be used with the present invention.

Figure 7:
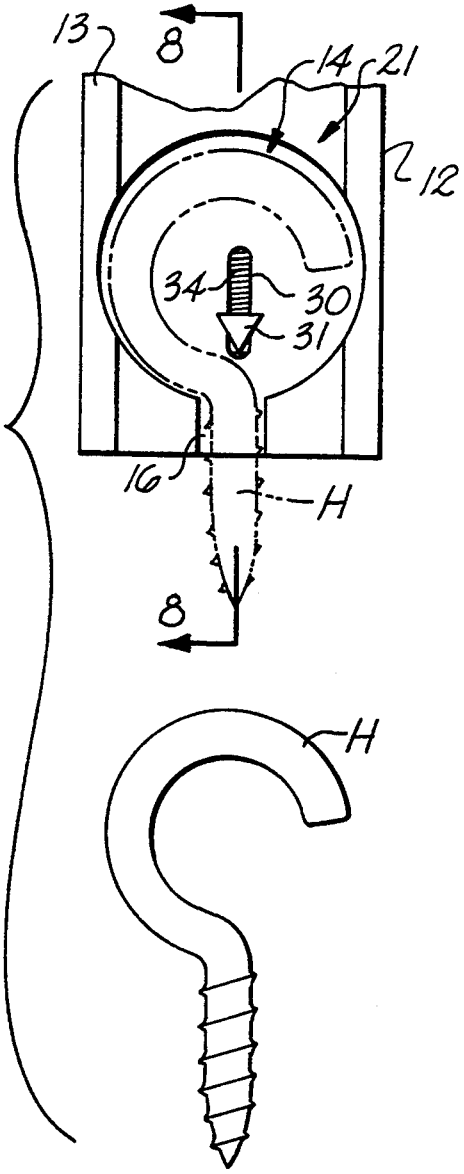
FIG. 7 is a top plan view of the end portion of the eye screw driving device illustrating a second embodiment of an optional selectively positionable post assembly for using the present invention with the range of eye screw sizes.

Referring now to FIG. 7, a second embodiment of a movable post is illustrated. FIG. 7 also illustrates the use of the present invention with an eye hook H instead of the eye screw as previously illustrated. To accomplish this version of the movable post, a slot 30 is formed in the recess 14 and extended linearly with respect to the rotational axis of the device. A post 31, shown in FIG. 7 as having a triangular end-on cross-sectional geometry is fitted within the slot.

Figure 8:
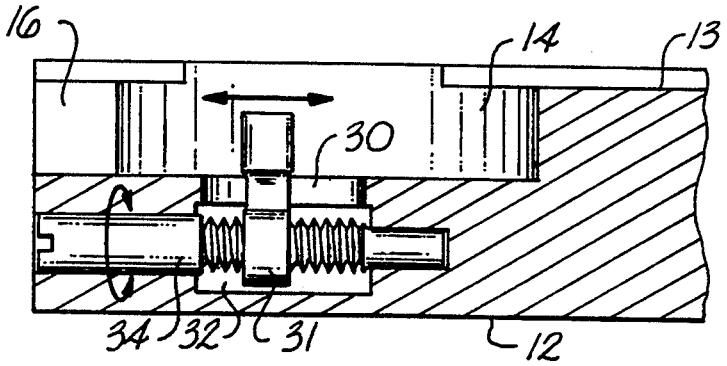
FIG. 8 is a cross-sectional view of the eye screw driving device taken along line 8—8 of FIG. 7 illustrating the mechanism for selectively positioning the post.

Referring now to FIG. 8, a cavity 32 is formed beneath the slot 30 into which a ball screw 34 is fitted. A threaded opening is formed in the post 31 and the ball screw 34 is thereby threadedly engaged with the post 31. Accordingly, rotation of the ball screw causes translatory movement of the post 31 linearly within the slot 30. Therefore, the user of the device may selectively position the post 31 to accommodate the cross sectional diameter of the head portion of a selected eye hook H. It should be emphasized that while the embodiments illustrated in FIGS. 7 and 8 include an eye hook H and the previous embodiments included an eye screw E, there is no preference for either an eye hook or an eye screw. Each embodiment of the present invention will work equally well with either an eye screw or an eye hook.

Figure 3:
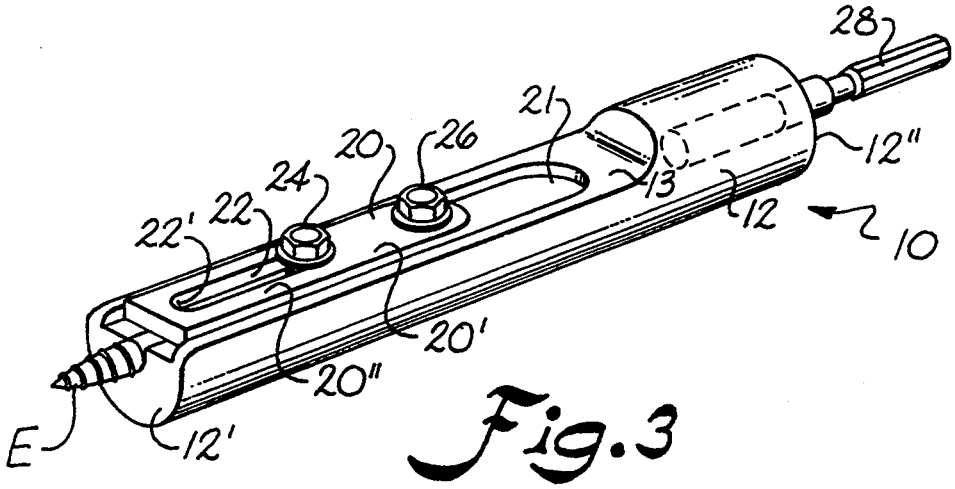
FIG. 3 is a perspective view of the eye screw driving device of FIG. 2 shown with an eye screw inserted therein and the cover in its extended position.

In operation, and with reference to FIG. 2, the cover 20 is moved to a retracted position to expose the recess 14. An eye screw E is inserted in the recess 14 with the shank portion disposed in the channel 16 so that the threaded portion of the shank projects outwardly from the front end 12'' of the device 10. The cover 20 is then moved forwardly to its extended position in covering relation with the recess 14 as seen in FIG. 3. The biasing spring 34 biases the rearward portion 20' of the cover 20 outwardly, causing, as previously described, the cover 20 to pivot at the screw 24 and thereby causing the forward portion 20'' of the cover 20 to be biased downwardly over the recess 14 area. In this manner, the cover 20 is retained in its extended position as seen in FIG. 3.

With the eyelet portion of the eye screw E mounted in the recess 14, the shank portion of the eye screw E in the channel 16, the threaded portion of the eye screw E projecting outwardly from the forward end 12' of the body 12 and the cover 20 in its extended position, the device 10 of the present invention may be mounted in a rotary power tool such as the screwdriver S with the mounting post 28 projecting into the chuck C of the power tool S as seen in FIG. 1. The eye screw E is then placed with its point in the desired position for driving and the power tool is actuated so that the device 10 is caused to rotate. If the power tool in use is of the type having variable speed control, it is best that the eye screw E be turned slowly because eye screws are typically formed with large threads having a relatively coarse pitch so that a relatively few turns is required to completely insert the screw. Once the eye screw E is inserted, the cover 20 may be moved to its retracted position to release the eye screw E from the device. It should be noted that while the device 10 of the present invention is particularly suited to operation with a rotary power tool, the inherent benefits can be realized with hand operation as well.

Eye screws may also be removed from a surface using the present invention- To accomplish this, the device is mounted to an inserted eye screw in the same manner as with a free eye screw. Then, either using a power driver or by hand, the eye screw is caused to back out of its mounted disposition. The eye screw may then be removed from the device and the removal process reinitiated with another mounted eye screw.

By the above, the present invention provides a simple and sure method of driving eye screws. The device is particularly suited to the situation wherein a person is required to drive a multiplicity of eye screws, since the device is configured for use with a power screwdriver or drill. Further, the present invention provides a device with relatively few moving parts and one of a particularly sturdy construction.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for use in driving insertion and removal of a plurality of differently-sized eye screws and hooks of the type having an eyelet-shaped head portion and a shank extending therefrom for rotational penetration of a supporting member, wherein said eye screws and hooks have respective head portions and respective shanks of a common cross-sectional dimension, but differ in the overall size of their respective head portions, said driving device comprising:

a body defining a rotational driving axis about which said body may be rotatably driven;

a recess in said body, said recess having a main area sized and configured in conformity to the head portion of the eye screw or hook of said plurality of eye screws and hooks which has the largest-sized head portion and a channel portion which opens to one end of said body and is sized and configured in conformity to the common cross-sectional dimension of the respective shanks of said plurality of eye screws and hooks, said recess being capable of receiving interchangeably any selected one of said plurality of eye screws and hooks with the respective head portion thereof disposed within the main area of the recess and the respective shank disposed within the channel portion of the recess to extend outwardly from said one end of said body in alignment with said rotational axis;

a cover device mounted on said body for selective sliding movement between an extended position disposed in covering relation to said recess for retaining the head portion of the eye screw or hook therein and a retracted position out of covering relation to said recess for selective insertion and removal of eye screws and hooks into and from said recess; and an upstanding post formed in said main area of said recess for insertion through the eyelet portion of any eye screw or hook received therein, said post being of a size and configuration to occupy no greater than the area within the eyelet portion of the eye screw or hook of said plurality of eye screws and hooks which has the smallest-sized head portion and to occupy less than the entirety of the area within the eyelet portion of each other eye screw or hook of said plurality of eye screws and hooks, said post being disposed at an offset within the main area of said recess to be spaced most closely to said channel portion, the spacing of said post to said channel portion corresponding to said common cross-sectional dimension of the head portions of said plurality of eye screws and hooks to prevent shifting movement within the main area of the recess by any eye screw or hook received therein.

2. An eye screw driving device according to claim 1 and further comprising a mounting device at the opposite end of said body from said recess-defining arrangement, said mounting device being configured for receipt in a chuck of a rotary drive tool.

3. An eye screw driving device according to claim 1 wherein said cover device is slidable in a linear path of movement.

4. An eye screw driving device according to claim 3 wherein said linear path of movement is generally parallel to said rotational driving axis of said body.

5. An eye screw driving apparatus according to claim 1 and further comprising an arrangement on said body for holding said cover device in said extended position.

6. An eye screw driving device according to claim 5 wherein said holding arrangement includes an assembly for biasing said cover device into frictional contact with said body.

7. An eye screw driving device according to claim 5 wherein said holding arrangement includes an assembly for biasing said cover device into said extended position.

8. A device for use in driving insertion and removal of eye screws and hooks of the type having an eyelet-shaped head portion and a shank extending therefrom for rotational penetration of a supporting member, said driving device comprising:

a body defining a rotational driving axis about which said body may be rotatably driven;

a recess in said body, said recess having a main area for receiving the head portion of an eye screw or hook and a channel portion which opens to one end of said body for positioning the shank to extend outwardly from said one end of said body in alignment with said rotational axis;

a cover device mounted on said body for selective sliding movement between an extended position disposed in covering relation to said recess for retaining the head portion of the eye screw or hook therein and a retracted position out of covering relation to said recess for selective insertion and removal of eye screws and hooks into and from said recess;

a series of substantially linearly aligned openings formed in said body within said main area of said recess; and a post configured for selective insertion into and removal from any of said openings for removably mounting said post in an upstanding manner within said recess, said post being configured for insertion through the eyelet portion of the eye screw.

9. An eye screw driving device according to claim 8 wherein said post may be selectively disposed at a predetermined spacing to said channel by inserting said spindle into one of said linearly aligned openings, said spacing corresponding to a selected cross-sectional dimension of the eye screw head portion, whereby said recess-defining arrangement is adapted for selective receipt of a plurality of eye screws having differing head portion sizes formed of said selected cross-sectional dimension.

10. An eye screw driving device according to claim 9 and further comprising an elongate slot formed in said recess into which said post is fitted for sliding movement therein and said post positioning assembly includes a ball screw threadedly mounted to said post wherein rotation of said ball screw causes translatory movement of said post within said slot for selectively positioning said post in said recess.

11. A device for use in driving insertion and removal of eye screws and hooks of the type having an eyelet-shaped head portion and a shank extending therefrom for rotational penetration of a supporting member, said driving device comprising:

a body defining a rotational driving axis about which said body may be rotatably driven;

a recess in said body, said recess having a main area for receiving the head portion of an eye screw or hook and a channel portion which opens to one end of said body for positioning the shank to extend outwardly from said one end of said body in alignment with said rotational axis;

a cover device mounted on said body for selective sliding movement between an extended position disposed in covering relation to said recess for retaining the head portion of the eye screw or hook therein and a retracted position out of covering relation to said recess for selective insertion and removal of eye screws and hooks into and from said recess;

a movable post mounted in said recess for insertion through the eyelet portion of the eye screw or hook.

12. An eye screw driving device according to claim 11 and further comprising an assembly on said body for selectively positioning said movable post within said recess at a spacing to said channel corresponding to a selected cross-sectional dimension of the eye screw head portion.

* * * * *